United States Patent [19]

Setterholm

[11] 4,057,859

[45] Nov. 15, 1977

[54] SUSPENDIBLE SLEEPING SURFACE AND TENT

[76] Inventor: Jeffrey M. Setterholm, 7392 Dale Ave., Apt. 3, Richmond Heights, Mo. 63117

[21] Appl. No.: 630,800

[22] Filed: Nov. 11, 1975

[51] Int. Cl.[2] ..... A45F 1/60

[52] U.S. Cl. ..... 5/121; 5/128

[58] Field of Search ..... 5/121, 128, 365, 343, 5/120, 123, 122; 135/DIG. 1, 1 R

[56] References Cited

U.S. PATENT DOCUMENTS

| | | | |
|---|---|---|---|
| 717,119 | 12/1902 | Potter | 5/122 |
| 1,260,845 | 3/1918 | Winder | 5/343 X |
| 2,284,900 | 6/1942 | Henderson et al. | 5/343 X |
| 3,339,216 | 9/1967 | Ormerod | 5/347 |
| 3,545,461 | 12/1970 | Carlson | 135/1 R |
| 3,964,113 | 6/1976 | Dean | 5/121 |

FOREIGN PATENT DOCUMENTS

| | | | |
|---|---|---|---|
| 66,892 | 2/1940 | Norway | 5/123 |

*Primary Examiner*—Casmir A. Nunberg
*Attorney, Agent, or Firm*—Polster, Polster & Lucchesi

[57] ABSTRACT

A flexible, tent-like structure, which may be entirely suspended above ground between sturdy tie points, encloses an occupant and provides an improved, cot-like sleeping surface. The structure is triangular in cross section and includes ropes running lengthwise of the structure along its three edges. Each of the three edges is concave when the structure is in an unloaded position. A spreader bar at the head of the structure and a triangular spreader frame at the foot of the structure are the only compression elements used. The structure may be tightly closed and a hole in the sleeping surface provides ventilation for breathing.

6 Claims, 9 Drawing Figures

SUSPENDIBLE SLEEPING SURFACE AND TENT

BACKGROUND OF THE INVENTION

This invention relates to sleeping surfaces, and in particular to an improved combination tent and sleeping surface which provides a cot-like sleeping surface without the use of longitudinal compression members (stiffeners).

There are presently known many different types of portable sleeping surfaces, such as cots, air mattresses, foam blocks and the like, all of which offer a flat, comfortable sleeping surface, given level and safe terrain on which to set them up. Hammocks of various types have been used where the terrain is not suitable or ground-supported sleeping surfaces, but hammocks have the disadvantage that, given tie points of less than infinite strength, the occupant's middle must sag in relation to his head and feet. Sag is also necessary to give the hammock any degree of stability. Hammocks suffer from the further disadvantage that the tension in the sleeping surface is almost entirely longitudinal (lengthwise) of the hammock. Therefore, the occupant's body acts as a transverse spreader, and the sides of the hammock tend to collapse inward around the occupant. Furthermore, the longitudinal tension supporting the occupant's trunk is substantially the same as the tension supporting the occupant's head and feet, thus making the longitudinal strip on which the occupant is lying uncomfortably rigid.

SUMMARY OF THE INVENTION

One of the objects of this invention is to provide a suspendible sleeping surface which overcomes the sag and instability problems of hammocks.

Another object is to provide such a sleeping surface which primarily supports the occupant's weight by forces in the sleeping surface oriented transversely of the structure rather than by forces oriented from head to foot.

Another object is to provide such a sleeping surface which does not require longitudinal compression elements (longitudinal stiffeners).

Another object is to provide such a sleeping surface which does not require compression elements in any orientation between the areas of the head and feet of the occupant.

Another object is to provide such a sleeping surface which functions as an occupant enclosure or tent.

Another object is to provide such a structure which exerts only moderate forces on the structures to which it is tied or from which it is otherwise supported.

Another object is to provide such an enclosure which may be substantially air-tight yet which provides adequate provision for breathing and reduces condensational problems within the enclosure.

Other objects will occur to those skilled in the art in light of the following description and accompanying drawings.

In accordance with one aspect of this invention, generally stated, a comfortable suspended sleeping surface is provided which includes a pair of longitudinal tension elements carrying between them a web of material defining the sleeping surface, and spreader means at the longitudinal ends of the sleeping surface for transversely spreading the tension elements, the tension elements being inwardly bowed toward the center of the web. Because the tension elements are inwardly bowed, when a longitudinal tension is applied to the tension elements they exert a transverse tensioning of the web of material. The inward curvature of the two longitudinal tension elements is chosen to provide desired local transverse tensions in the sleeping surface web along its length. The spreader means are preferably transverse compression elements at the head and foot of the sleeping surface.

In accordance with another aspect of the invention, a third longitudinal tension element is provided above the sleeping surface web, and means connecting the third tension element with the longitudinal edges of the sleeping surface web bow the longitudinal edges of the web upward intermediate the head and foot of the sleeping surface when the sleeping surface is unoccupied. The upward bow of the longitudinal edges of the sleeping surface web and the downward curvature of the third tension element are so chosen that, when the structure is occupied, the longitudinal edges of the sleeping surface have a desired contour (e.g. generally straight lines lying in a horizontal plane) and the third tension element provides desired local lifting forces along its length.

The combination of three inwardly bowed tension elements in accordance with the foregoing aspects of the invention supports an occupant's weight by tension forces acting on the apex of the structure through the side walls; the occupant's weight is supported between the sides of the structure rather than by forces in the sleeping surface oriented from head to foot. The combination of tension elements thus permits the designer to provide a cot-like sleeping surface without the longitudinal edge stiffeners of a cot. It also permits the local contour and firmness of the loaded sleeping surface to be tailored for different body sizes and different tastes. For example, the design may be chosen to make the lower pair of tension elements lie in a horizontal plane when the structure is loaded, so the tensions in them have no vertical component. They therefore act as spreaders of the sleeping surface but do not support it. Hence, the curvature of the upper tension element can be calculated from a preselected weight distribution in the loaded structure and the design tension in the upper tension element; thereafter, the necessary curvature of the lower tension elements can be computed to provide the necessary transverse force at each longitudinal position in the sleeping surface. Enough transverse sag must be provided throughout the loaded sleeping surface to keep the tension in the lower tension elements realistically low. For example, the preferred embodiment of structure described hereinafter is designed for an occupant about 72 inches tall and produces a uniform sag of approximately 6 inches under most of the occupant while keeping tangential forces in the tension elements (between the head and foot of the sleeping surface) below 1.25 times the occupant's weight; the total horizontal load between tie points is approximately three times the occupant's weight.

The structure of the invention preferably includes three panels joined along their longitudinal edges to form a body part which is triangular in cross section, with the tension elements extending generally along the edges (arrises) along which the panels are joined.

The tension elements are preferably ropes secured to the body part along the arrises and extending beyond the head and foot of the body part. At the foot end of the structure, the three ropes are secured to the apexes of a triangular external frame; they are brought back from the frame to a common tie point. The three panels are extended to the tie point, to close the foot of the body part. At the head of the structure, the lower ropes are secured to a horizontal spreader bar and are brought out to a common tie point. The upper rope is brought out at the head of the structure and tied above the lower rope tie point, to stabilize the structure and provide easy access through flap closures in the body part.

The triangular cross section is preferred because it sheds rain, simplifies the fabrication of the body part and the spreader structures, resists warpage under load, and provides maximum stability.

The body part may be made of any material having sufficient strength, preferably a light-weight material. In the preferred embodiment, the material is subjected to a transverse tension of only about ten pounds per inch when the structure is loaded. The material may be either permeable or impermeable to moisture and air. If the body of the structure has poor ventilation, a screened-in port at the head of the sleeping surface permits the occupant to breath through the sleeping surface without dissipating heat from the enclosure and without adding excessive moisture within the enclosure. The port may have a length of from about ½ inch to about 4 inches and a width of from about ½ inch to about 4 inches. A closure flap allows the screened-in port to be covered. Two front flaps are provided at the head of the body part: a screened flap and a wind-proof flap.

If one spreader, or both, is to contact the terrain, modified spreader geometries and aft (foot) harnesses can be provided.

DESCRIPTION OF THE PREFERRED EMBODIMENT

Figure 1:
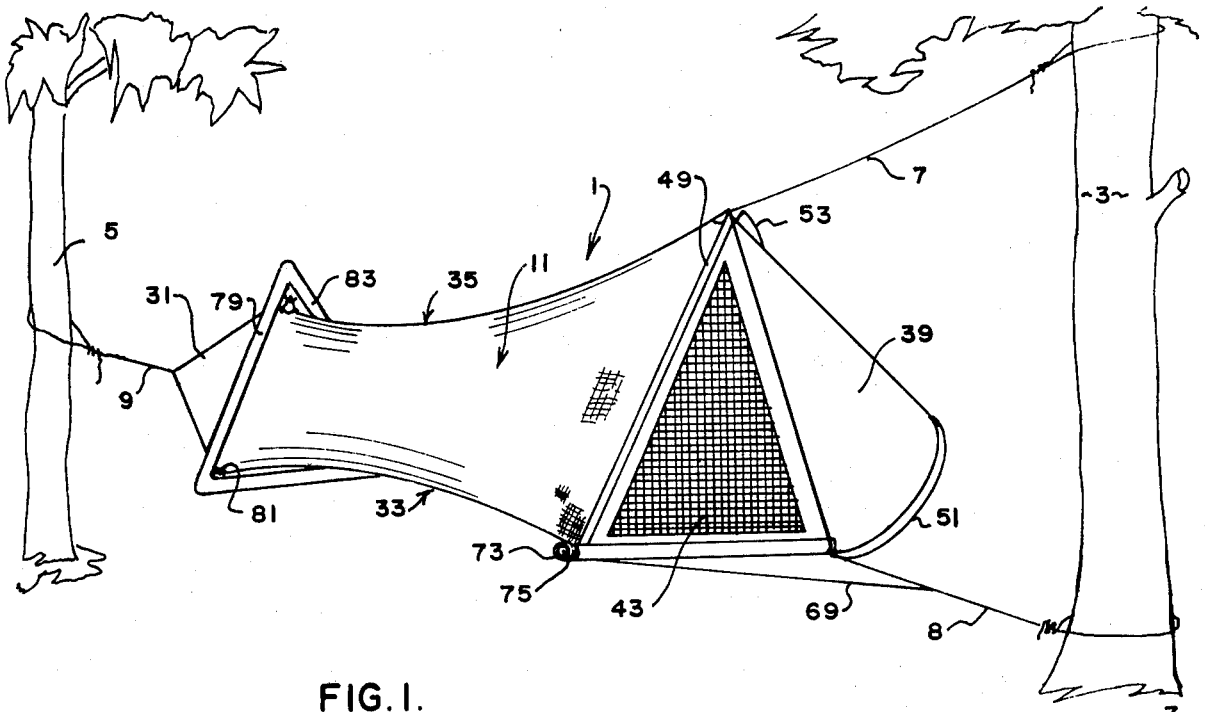
FIG. 1 is a view in perspective of a suspended tent structure of the present invention, showing it extended between two trees and in an unoccupied condition.
Figure 2:
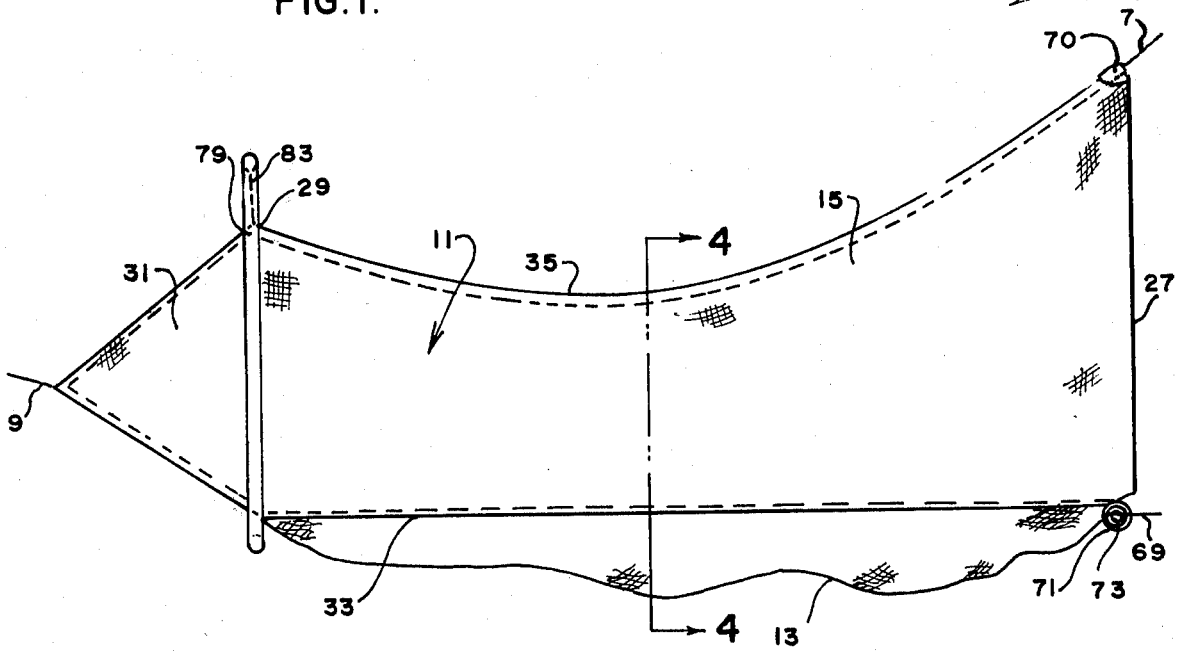
FIG. 2 is a view in side elevation of the structure of FIG. 1, showing the structure occupied.
Figure 3:
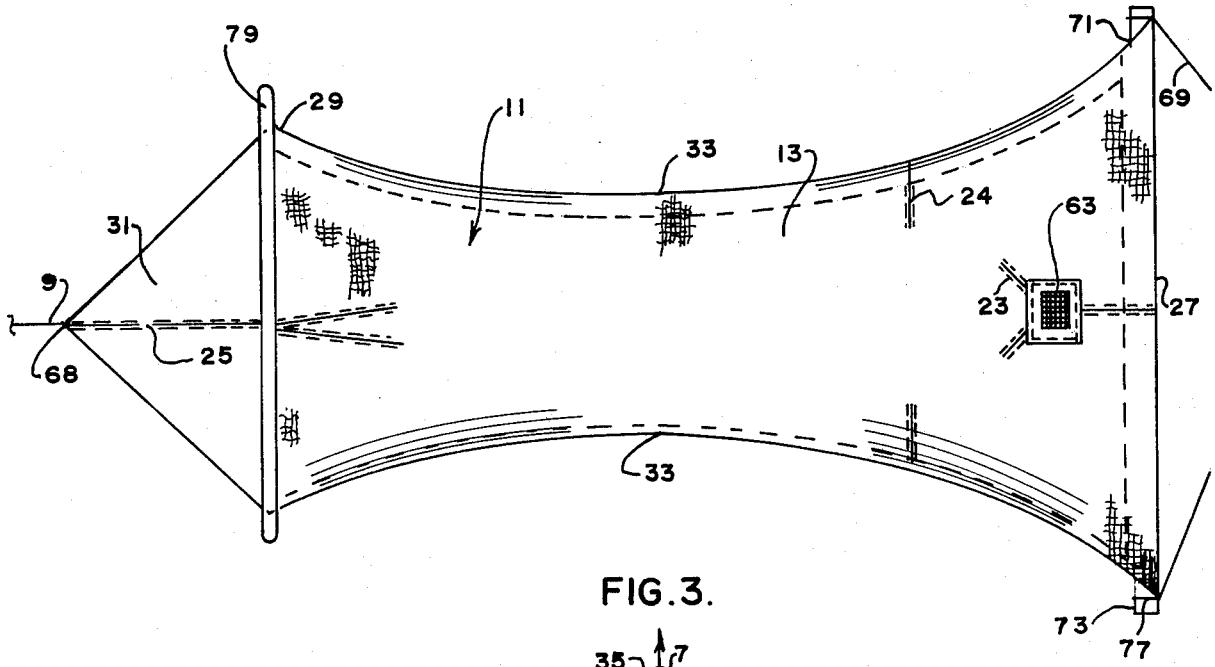
FIG. 3 is a bottom plan view of the occupied structure of FIGS. 1 and 2.
Figure 4:
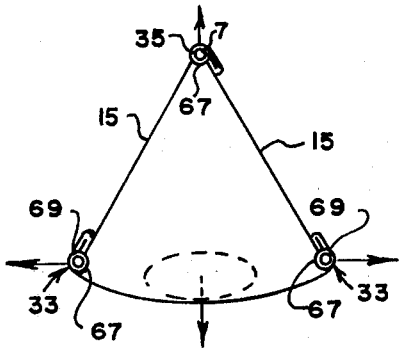
FIG. 4 is a somewhat diagrammatic view in transverse cross section, taken along the line 4—4 of FIG. 2 and illustrating forces generated in the structure of FIGS. 1–3 when the structure is occupied.
Figure 5:
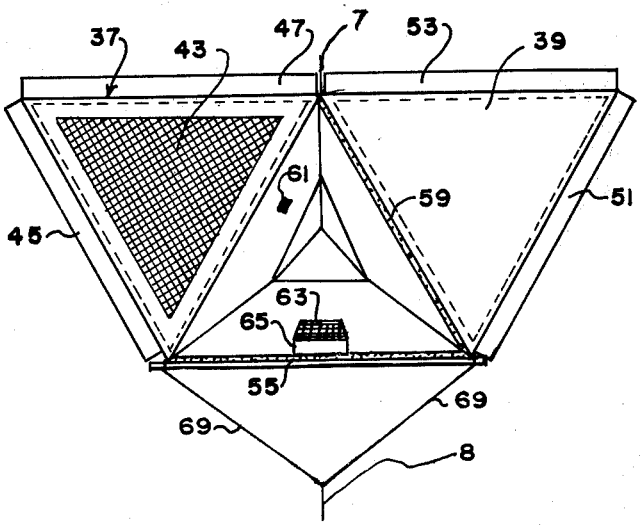
FIG. 5 is a view in front elevation of the unoccupied structure of FIGS. 1–4, showing a pair of closure flaps extended.
Figure 6:
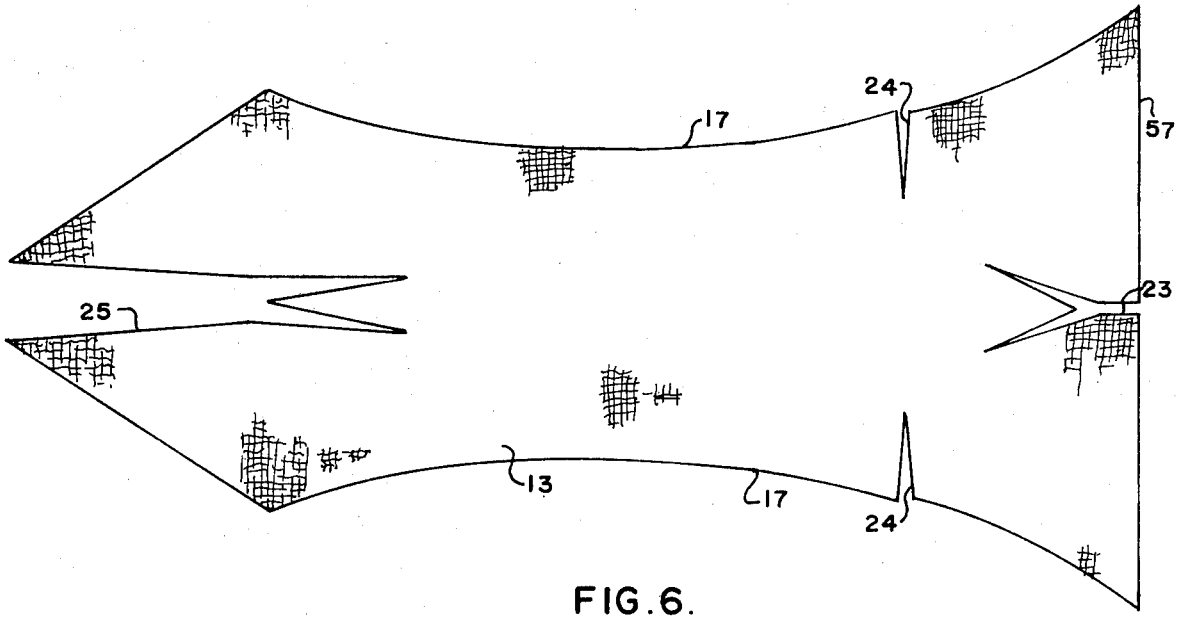
FIG. 6 is a pattern for a sleeping surface panel of the structure of FIGS. 1–5.
Figure 7:
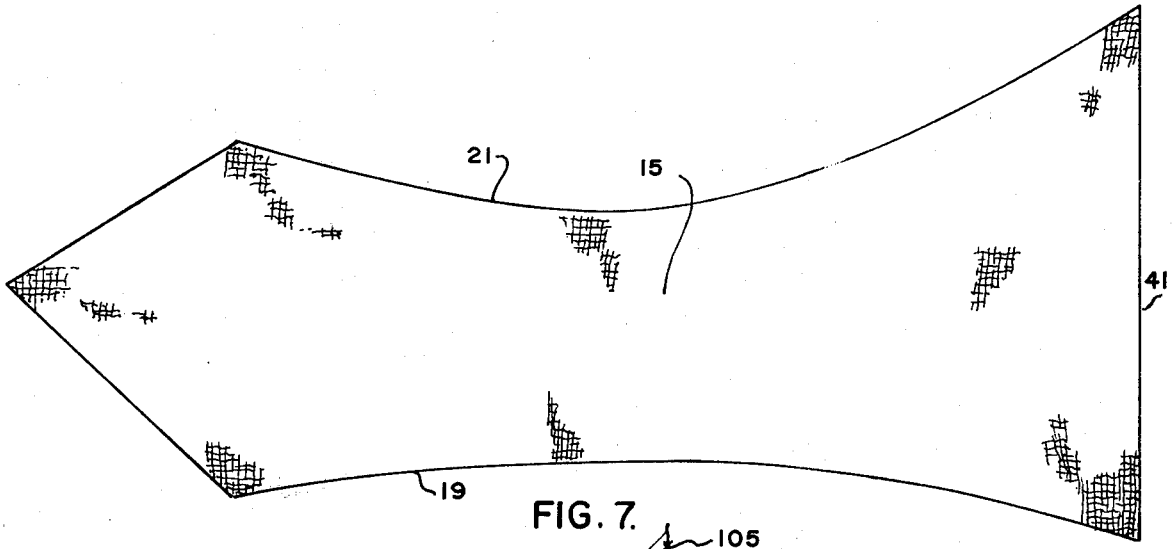
FIG. 7 is a pattern for a side panel of the structure of FIGS. 1–5.

Referring now to the drawings, and in particular to FIGS. 1–7, reference numeral 1 indicates a preferred embodiment of suspendible sleeping surface and tent structure of this invention. The structure 1 is suspended between a first tree 3 and a second tree 5 by means of an upper rope 7 tied to the first tree 3, a lower rope 8 tied to the first tree 3, and a third rope 9 tied to the second tree 5.

The structure 1 includes a body part 11 formed of three panels or webs of material: a lower (sleeping surface) panel 13 and a pair of identical side panels 15. Numerous suitable materials are known including canvas and certain nylon mesh sandwich materials such as those sold under the trademarks Herculite and Hypalon. The presently preferred material is a woven nylon having high resistance to tearing and having a strength such that a 1-inch strip can sustain 50 pounds of tension. The longitudinal edges 17 of the lower panel 13 are sewn to the lower longitudinal edges 19 of the side panels 15, and the upper edges 21 of the side panels 15 are sewn to each other to form an enclosure which is triangular in cross section. Before the panels are joined, tucks are taken in the lower panel 13 as indicated at 23, 24 and 25. The tucks provide a desired contour of the lower surface 13 and ensure a proper fit between its edges 17 and the lower edges 19 of the side panels. The edges 17, 19 and 21 are all inwardly bowed from a head end 27 of the body part 11 to a foot 29 of the body part 11. Aft of the foot 29 (i.e. to the left as viewed in FIGS. 2, 3, 6 and 7), the panel edges 17, 19 and 21 are joined to form a boot 31 in the form of a triangular pyramid. The joined edges 17 and 19 form lower arrises 33 of the body part 11, and the joined edges 21 form an upper (apex) arris 35.

At the head 27 of the body part 11, a pair of triangular flaps 37 and 39 are sewn to the front edges 41 of the side panels 15. The first triangular flap 37 includes a central screen 43. Along the free edges of the first flap 37 are sealing flaps 45 and 47 which carry, on their outside faces (the far side as viewed in FIG. 5), strips of one type (i.e. hook-type or pile-type) of a hook-and-pile closure material, such as a material sold under the trademark Velcro. A strip 49 of a second, mating, type of Velcro is attached to the outside of the flap 37, along its juncture with the front edge 41 of the body side panel 15.

The second triangular closure flap 39 is made of the same material as the body part 11. The second flap 39 also includes a first sealing flap 51 and a second sealing flap 53, both of which carry a strip of a first type of Velcro on their outside faces.

A strip 55 of the second type of Velcro is provided along the front edge 57 of the lower body panel 13, and a similar strip 59 is provided along the front edge 41 of the body side panel 15 to which the second triangular flap 39 is sewn.

It will be seen that the screened flap 37 may be closed and sealed from inside the body part 11 by turning the flaps 45 and 47 inward and pressing them against the strips 55 and 59. When the wind-proof closure flap 39 is to be closed, the screened flap 37 is pulled completely inside the body part 11 and may be attached to a Velcro piece 61 on the inside of the adjacent side panel 15. The sealing flap 51 on the closure flap 39 is then attached to the lower Velcro strip 55, and the sealing flap 53 is attached to the strip 49 on the screened flap 37.

About twelve inches from the head end 27 of the body part 11, a screened-in breathing port 63 is sewn into the lower panel 13. A covering flap 65 allows the port 63 to be covered if desired. Because the port 63 is beneath the position of an occupant's nose and mouth, it permits the occupant to breath through the lower surface 13 without adding the moisture from his lungs to the air in the enclosure. The port 63 may, for example, be 2 inches long and 3 inches wide. The screening may be a high strength nylon screen material having strength properties comparable to those of the panels 13 and 15.

The bottom panel 13 and side panels 15 are sewn together with at least a double row of stitches, to form casings 67 extending along the three arrises 33 and 35. Ropes 69 are held in casings 67 extending along the lower arris 33, and the upper rope 7 is held in the casing 67 along the upper arris 35. At the apex 68 of the pyramidal boot 31, the two lower ropes 69 and the upper rope 7 are tied to each other and to the attachment rope 9. At the head 27 of the body part, the upper rope 7 is secured to a reinforcing piece 70. At the forward end of the body part 11, about three feet of the lower ropes 69 extend from the casings 67 and are tied to each other and of the attachment rope 8.

At the front edge 57 of the sleeping surface panel 13, a transverse casing 71 carries an aluminum tube 73. The tube 73 has a hole 75 drilled through it in a direction transverse of its axis at each of its ends. The ropes 69 are brought around the tube 73 and through the holes 75, as shown at 77. The holes 75 are spaced apart a distance which ensures that the front edge 57 of the sleeping surface 13 is pulled smooth along the tube 73. The tube 73 thus forms a first transverse spreader element for the ropes 69, and hence for the sleeping surface panel 13. The tube 73 must be of sufficient diameter and wall thickness to resist bending when the structure is pulled taut. A heavy gauge 1-inch diameter tube has been found to be suitable.

At the foot 29 of the body part 11, the lower ropes 69 and upper rope 7 are accessed through external openings in the casings 67 and are secured to the apexes of an external triangular frame 79, as shown at 81 and 83, respectively. The connection may be by means of S-hooks, for example. The triangular frame 79 is made of a lighter gauge aluminum tubing than the forward tube 73, because the forces at the foot of the structure are less than at the head, and because the forces exerted in it are primarily compressive. The triangular frame 79 holds the ropes 69 and 7 apart and acts as an aft spreader.

The point 68, at which the lower ropes 69 and upper rope 7 are tied to the rearward attachment rope 9, is chosen to counterbalance the forces exerted by the loaded structure forward of the aft spreader 79. The rearward harness, consisting of the sides of the triangular boot 31 and the portions of the ropes 69 and 71 aft of the foot 29, is thus pulled taut when the structure is suspended and occupied.

The illustrative structure 1 of the present invention is designed for a person about 6 feet tall, weighing about 170 pounds. The illustrative structure 1 is 8 feet long, and the body part 11 has a length of 78 inches from front 27 to foot part 29.

The illustrative structure 1 is 8 feet long. If the trees 3 and 5 are 14 feet apart, and the structure 1 is positioned halfway between them, the upper rope 7 may be tied at a height of about 7 feet, the lower rope 8 may be tied at a height of about 2 feet, and the aft rope 9 may be tied at a height of about 3¼ feet. For convenience, the upper rope 7 is tied first, then the aft rope 9 is pulled taut and tied, and then the lower rope 8 is pulled taut and tied. When the structure is occupied, the rope 7 may be pulled to a tension of about 210 pounds, the rope 8 to a tension of about 340 pounds, and the rope 9 to a tension of about 520 pounds.

In the illustrative structure 1, carrying its design load, the distance between the upper rope 7 and each lower rope 69 is 45.5 inches at the head 27 of the body part 11, 20.6 inches at the minimum cross section (line 4—4), and 29.8 inches at the foot 29. In the loaded structure, the distance between the lower ropes 69 is 49.4 inches at the head 27, 20.6 inches at the minimum cross section, and 32.7 inches at the foot 29. The width of the lower panel 13 between the head and foot of the body part 11 is chosen to provide a desired sag at each cross section of the occupied structure; at the minimum cross section, the width of the panel 13 is 26.0 inches.

The illustrated curvatures of the arrises 33 and 35 were chosen to provide a generally uniform sag of about 6 inches in the sleeping surface panel 13 at each cross section of the structure, except near the head and foot of the panel 13. As shown schematically in FIG. 4, at each cross section the horizontal force components generated by a reclining occupant are completely balanced by the outward forces exerted by the ropes 69, and substantially the entire vertical force component is transmitted through the side panels 15 to the apex rope 7. The local curvature and local tension of the upper arris 35 (including rope 7) are designed for the loaded structure and are so chosen that all downward forces in the loaded structure at each cross section are borne at that cross section by the arris 35. Therefore, for an approximately known load distribution, longitudinal stresses in the tent body, other than in the arrises, are effectively eliminated.

Figure 8:
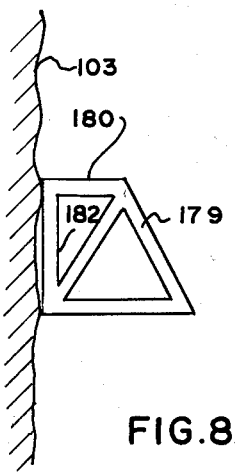
FIG. 8 is a diagrammatic representation of a modified aft spreader piece of the present invention.
Figure 9:
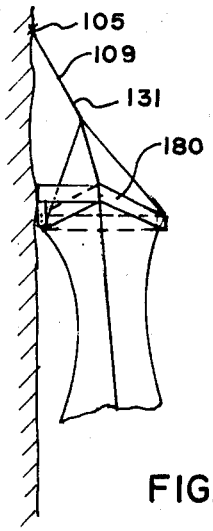
FIG. 9 is a somewhat diagrammatic partial view of a modified tent structure of the present invention, utilizing the modified spreader of FIG. 8.

Numerous variations in the tent and sleeping surface of the present invention, within the scope of the appended claims, will occur to those skilled in the art in light of the foregoing disclosure. For example, although the structure has been described as suspended between trees, it may be suspended or supported in other ways. As shown diagrammatically in FIGS. 8 and 9, the structure may easily be modified for support from a rock face 103 by simple changes in the aft spreader and aft harness. The modified aft spreader 179 includes a triangular frame and an additional horizontal arm 180 which supports an additional vertical arm 182. The vertical arm 182 stabilizes the structure against the face 103. The ropes of this embodiment are held to the rock wall by pitons, as shown at 105. Because the angle of the aft rope 109 is different from the angle of the rope 9 of the preferred embodiment, the aft harness must also be made somewhat asymmetrical, as shown at 131.

Other variations will also occur to those skilled in the art. For example, the body part may be reproportioned, or it may be made of quite different materials. The ropes may be made of other materials, may be repositioned with respect to the body part, or may even be eliminated except at the ends of the body part if the arrises of the body part are sufficiently strong. Different compression elements may be used, or different spreader means altogether may be used. For example, it is possible to use an aft spreader which, like the forward spreader, is linear and to tie the aft end of the upper rope 7 to the same tree as the aft rope 9. It is also possible to spread the ropes at the head and foot of the sleeping surface by pulling them toward laterally spaced fixed support points, although this approach has obvious drawbacks. Cross sectional shapes of the structure other than triangular are also possible but are believed to be far less desirable. The closure flaps may be redesigned. For example, they may be made integral with the side panels 15, or may be sealed differently, or entirely different closure systems may be provided. These variations are merely illustrative.

I claim:

1. A suspendible combination tent and sleeping surface structure for enclosing and supporting an occupant, said structure comprising:

body means for enclosing said occupant, said body means having a generally horizontal longitudinal axis and being formed of a flexible material, a lower web of said body means forming a sleeping surface for said occupant;

transverse compression element means, at the longitudinal ends of said body means, for spreading the lower surface of said body means in a direction transverse of said longitudinal axis; and suspension means for suspending said body means between fixed tie points and for applying a longitudinal tension to said body part, said structure being characterized in that when the structure is unoccupied the longitudinal edges of said lower web portion are inwardly bowed as viewed in top plan, the lower web portion is upwardly bowed as viewed in side elevation, and the upper edge of said body part is downwardly bowed as viewed in side elevation, said structure being further characterized in that when said structure is occupied tension in the lower web is primarily tranverse and is substantially more than half the local occupant weight, so that transverse horizontal spreading of said lower web portion is accomplished primarily by tension in the structure, and in that vertical force components supporting local occupant weight are transferred from the edges of the sleeping surface to a portion of the body means above the occupant.

2. A suspendible combination tent and sleeping surface structure for providing a comfortable suspended sleeping surface without the use of longitudinal compression members, the structure comprising:

A. three panels defining a body part of generally triangular cross section, each panel being made of flexible material, said panels comprising:

a generally horizontal panel defining a sleeping surface having a head and a foot at the respective longitudinal ends thereof, and having a pair of inwardly curved longitudinal edges;

a first side panel, an inwardly curved lower edge of said first side panel being joined to said generally horizontal panel to define a first upwardly and inwardly curved longitudinal arris of said structure;

a second side panel, an inwardly curved lower edge of said second side panel being joined to said generally horizontal panel along the other longitudinal edge of said generally horizontal panel to define a second upwardly and inwardly curved longitudinal arris of said structure;

inwardly curved upper edges of said first and second side panels being joined to each other to define a downwardly curved longitudinal apex arris of said structure;

B. first spreader means at the head of said sleeping surface for transversely spreading said generally horizontal panel;

C. second spreader means at the foot of said sleeping surface for transversely spreading said generally horizontal panel; and D. tie means, attachable to fixed elements beyond the longitudinal ends of said sleeping surface, for exerting tension in all three of said arrises when said structure is suspended, said structure being so constructed and proportioned that when said structure is occupied: tension in the horizontal panel is primarily transverse and is substantially more than half the local occupant weight, so that transverse horizontal spreading of said lower web portion is accomplished primarily by tension in the structure, and vertical force components supporting local occupant weight are transferred from the first and second arrises by said first and second side panels to said apex arris.

3. The structure of claim 2 wherein said first spreader means comprise a transverse compression element and wherein said second spreader means comprise a triangular frame for spreading said side panels as well as said generally horizontal panel.

4. The structure of claim 3 wherein said tie means include lower head-end tie lines for securing said transverse compression element to a first tie point, an upper head-end line for securing said apex arris to a second tie point above said first tie point, and footend tie lines for securing said triangular frame to a third tie point horizontally spaced from said first and second tie points.

5. The structure of claim 4 including three ropes extending along said arrises and attached thereto.

6. The structure of claim 5 wherein said ropes are connected to said triangular frame and converge to a single line beyond the foot of the structure, said body part including extensions of said three panels joined to each other along said foot-end tie lines and including closure means at the head of said body part, said closure means comprising a screened triangular flap, a second closure flap and means for releasably closing said flaps.

* * * * *